US009010920B2

(12) United States Patent
Nishimura

(10) Patent No.: US 9,010,920 B2
(45) Date of Patent: Apr. 21, 2015

(54) DRYING DEVICE AND INK JET RECORDING APPARATUS EQUIPPED WITH THE SAME

(75) Inventor: Takatoshi Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 218 days.

(21) Appl. No.: 13/434,537

(22) Filed: Mar. 29, 2012

(65) Prior Publication Data

US 2012/0249703 A1 Oct. 4, 2012

(30) Foreign Application Priority Data

Mar. 29, 2011 (JP) ..... 2011-072097

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 2/01; B41J 29/38; B41J 29/13
USPC ..... 347/102
See application file for complete search history.

(56) References Cited

U.S. PATENT DOCUMENTS 5,812,153 A * 9/1998 Watanabe et al. ..... 347/3
6,340,225 B1 1/2002 Szlucha
6,354,015 B1 3/2002 Ogasawara et al.
6,390,618 B1 5/2002 Wotton
2009/0021549 A1* 1/2009 Muto ..... 347/16
2009/0244160 A1* 10/2009 Nakagaki ..... 347/16
2010/0103237 A1* 4/2010 Hara et al. ..... 347/102
2010/0180784 A1 7/2010 Shiohara
2010/0188455 A1 7/2010 Shinkawa et al.
2011/0037819 A1* 2/2011 Mizutani ..... 347/108

FOREIGN PATENT DOCUMENTS

JP 2001-71473 A 3/2001
JP 2007-038429 A 2/2007
JP 2010-83040 A 4/2010
JP 2010-167737 A 8/2010

OTHER PUBLICATIONS

English language abstract for JP 2001-71473 A, published Mar. 21, 2001.
English language abstract and machine translation for JP 2010-83040 A, published Apr. 15, 2010.
English language abstract for JP 2010-167737 A, published Aug. 5, 2010.

* cited by examiner

*Primary Examiner* — Alessandro Amari
*Assistant Examiner* — Alexander C Witkowski
(74) *Attorney, Agent, or Firm* — NDQ&M Watchstone LLP

(57) ABSTRACT

A drying device of this disclosure is a drying device that dries ink discharged onto a surface of a recording medium and includes a drying conveyor portion and a blower portion. The drying conveyor portion conveys the recording medium. The blower portion blows air toward the recording medium substantially parallel to an ink recording surface of the recording medium being conveyed by the drying conveyor portion.

8 Claims, 7 Drawing Sheets

DRYING DEVICE AND INK JET RECORDING APPARATUS EQUIPPED WITH THE SAME

The present application is based on Japanese Patent Application No. 2011-072097 filed on Mar. 29, 2011, the contents of which are hereby incorporated by reference.

BACKGROUND

1. Field

The present disclosure relates to a drying device for drying ink discharged onto a surface of a recording medium such as a paper sheet. The present disclosure relates also to an ink jet recording apparatus equipped with the drying device, which performs recording on a recording medium such as a paper sheet by discharging ink from a plurality of nozzles.

2. Description of Related Art

Recording apparatuses including a copy machine, a printer, and a facsimile are configured to record images such as characters, graphics, patterns, and so forth on a recording medium such as a piece of paper, a piece of cloth, an OHP sheet, or the like. Recording methods adopted by these types of recording apparatuses can be classified into a dot impact method, a thermal transfer method, an electrophotographic method, an ink jet method, and so forth. Furthermore, these recording methods can be classified further into a serial type and a line head type. The serial type is a technique in which a recording head performs recording while scanning over a recording medium in a direction perpendicular to a conveying direction of the recording medium. The line head type is a technique in which a recording head formed to be relatively elongated in a direction perpendicular to a conveying direction of a recording medium is fixed to an apparatus and performs recording on an entire surface of the recording medium as the recording medium is conveyed.

For example, a line head type ink jet recording apparatus includes a line head having a recording region in a direction perpendicular to a conveying direction of a recording medium such as a paper sheet, namely, a recording region corresponding to the width of the recording medium. The line head type ink jet recording apparatus records, while conveying the recording medium, an image on the recording medium by discharging ink onto a surface of the recording medium from each nozzle of the line head. This allows the line head type ink jet recording apparatus to perform higher-speed recording compared with a serial type ink jet recording apparatus in which a recording head performs scanning in a width direction of a recording medium.

Among such ink jet recording apparatuses is a type equipped with a drying device that dries ink discharged onto a recording medium, which has been disclosed as prior art. An ink jet recording apparatus of this type, which has been disclosed as prior art, includes a drying device having a drying fan that is provided in opposition to an ink recording surface of a recording medium and blows air toward the ink recording surface. That is, by using the drying fan, the drying device blows air from above toward an upper surface of the recording medium onto which ink has been discharged in an attempt to dry the ink.

In order for ink discharged onto a recording medium to be dried as quickly as possible, moisture in the ink needs to evaporate quickly. The simplest method for causing moisture in the ink to evaporate is to blow air toward the ink as the above-described conventional drying device does.

At the time when ink evaporates, a diffusion layer of water vapor that has not reached its saturation water vapor pressure is formed around the ink. The evaporation proceeds as moisture passes outward through the diffusion layer. Increasing the flow velocity of air around the ink allows the water vapor diffusion layer to be formed with a decreased thickness. In this case, since the gradient of a water vapor pressure increases with decreasing thickness of the water vapor diffusion layer, the evaporation of moisture in the ink can be further accelerated.

In a case of causing moisture in ink to evaporate by utilizing an airflow as described above, a drying device should be structured so as to provide an airflow having a highest possible velocity. In the above-described conventional drying device, however, since a blow-off port of the drying fan is provided in opposition to an ink recording surface of a recording medium, an airflow flows to directly strike the ink recording surface. For this reason, an airflow generated by the drying fan is likely to be immediately decelerated, and this deceleration is observed significantly at a position distant from the blow-off port.

Furthermore, in the above-described prior art, an airflow generated by the drying fan directly impinges only on a narrow area immediately below the blow-off port. As a result, a period of time in which an airflow generated by the drying fan directly impinges on a recording medium being conveyed is extremely short. Hence, in a case where a drying device capable of continuous and high-speed processing is desired, the above-described prior art cannot be said to be effective enough to dry ink discharged onto a recording medium as quickly as possible, thus leaving room for improvement.

SUMMARY

The present disclosure has been made in view of the above and provides a drying device that is capable of drying ink discharged onto a surface of a recording medium as quickly as possible. And the present disclosure provides an ink jet recording apparatus equipped with this drying device, which provides increased reliability and is capable of high-speed recording.

A drying device according to one aspect of the present disclosure is a drying device that dries ink discharged onto a surface of a recording medium and includes a drying conveyor portion and a blower portion. The drying conveyor portion conveys the recording medium. The blower portion blows air toward the recording medium substantially parallel to an ink recording surface of the recording medium being conveyed by the drying conveyor portion.

Other features and advantages of the present disclosure will be even further clarified by embodiments described hereafter.

DETAILED DESCRIPTION

Based on FIGS. 1 to 8, the following describes embodiments of the present disclosure. It is to be noted, however, that requirements such as regarding configurations, dispositions, and so forth described in the embodiments are only illustrative and not intended to limit the scope of the invention.

Figure 1:
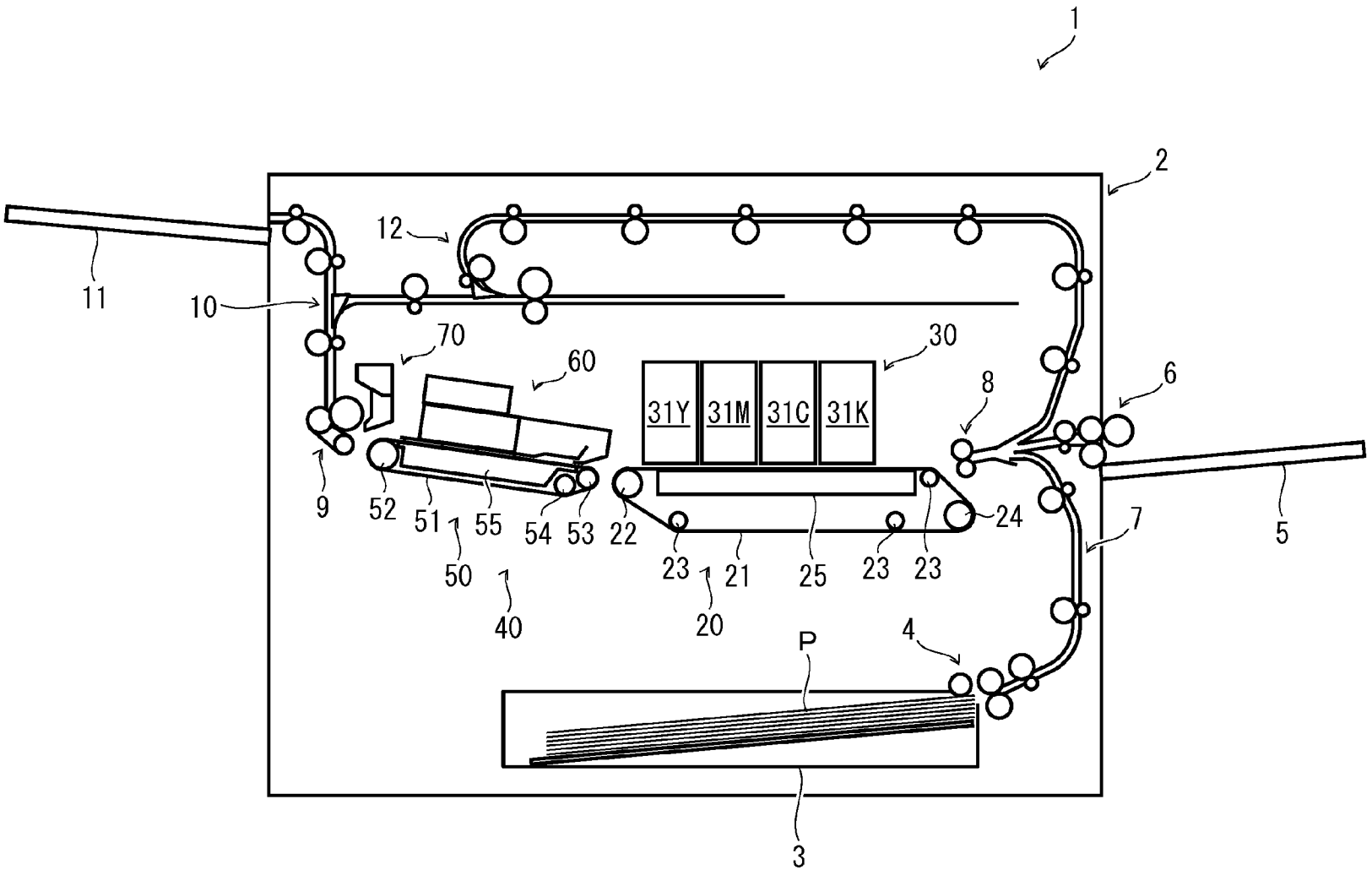
FIG. 1 is a schematic vertical sectional front view of an ink jet recording apparatus equipped with a drying device according to a first embodiment of the present disclosure.

First, a description is made of a recording operation of an ink jet recording apparatus equipped with a drying device according to a first embodiment of the present disclosure while briefly explaining a structure of the ink jet recording apparatus with reference to FIG. 1. FIG. 1 is a schematic vertical sectional front view of an ink jet type printer as one example of the ink jet recording apparatus.

As shown in FIG. 1, a paper feed cassette 3 that is a paper sheet housing portion is disposed on the lower side in a main body 2 of a printer 1. The paper feed cassette 3 houses therein, for example, a pile of about 500 paper sheets P that are recording media, such as sheets of cut paper before being subjected to printing. A paper feed device 4 is disposed at a downstream portion of the paper feed cassette 3 in a paper sheet conveying direction, i.e. on the upper right side of the paper feed cassette 3 in FIG. 1. By the paper feed device 4, the paper sheets P are fed out separately one by one toward the upper right side of the paper feed cassette 3 in FIG. 1. The paper feed cassette 3 can be pulled out horizontally from the front side of the main body 2 for the purpose of being replenished with a fresh supply of paper sheets P.

A manual paper feed tray 5 is provided at a position outside a right side surface of the main body 2. On the manual paper feed tray 5, paper sheets having a size different from the size of the paper sheets housed in the paper feed cassette 3, recording media that can hardly be passed along a bent conveying path, such as sheets of cardboard, OHP sheets, envelopes, and postcards, other types of recording media that are desired to be fed manually one by one, or the like are placed. A paper feed device 6 is disposed at a downstream portion of the manual paper feed tray 5 in a paper sheet conveying direction, i.e. on the left side of the manual paper feed tray 5 in FIG. 1. By the paper feed device 6, paper sheets on the manual paper feed tray 5 are fed out separately one by one toward the left side in FIG. 1.

Furthermore, the printer 1 includes therein a paper sheet conveying portion 7. The paper sheet conveying portion 7 is situated on the right side relative to the paper feed cassette 3, i.e. in a direction in which a paper sheet ejected from the paper feed cassette 3 is conveyed, and on the left side relative to the manual paper feed tray 5. The paper sheet conveying portion 7 conveys the paper sheet P fed out from the paper feed cassette 3 toward the vertical upper side along the side surface of the main body 2 and conveys a paper sheet fed out from the manual paper feed tray 5 toward a substantially horizontal left side.

A registration roller pair 8 is provided at a downstream end of the paper sheet conveying portion 7 in the paper sheet conveying direction and on the immediately upstream side of a recording conveyor portion 20. On the further downstream side thereof, the recording conveyor portion 20 and a recording portion 30 are disposed. The paper sheet P fed out from the paper feed cassette 3 or the manual paper feed tray 5 passes through the paper sheet conveying portion 7 to reach a position where the registration roller pair 8 is provided. While correcting oblique feeding of the paper sheet P, the registration roller pair 8 feeds out the paper sheet P toward the recording conveyor portion 20 in synchronization with timing at which the recording portion 30 carries out an ink discharging operation. In the paper sheet conveying portion 7, a conveying roller pair for conveying the paper sheet P may be provided as required.

The recording conveyor portion 20 includes an endless recording conveyor belt 21 wound around a drive roller 22, a driven roller 23, and a tension roller 24. The recording conveyor belt 21 is rotated by the drive roller 22 in a counterclockwise direction in FIG. 1. The paper sheet P fed out by the registration roller pair 8 is placed on an upper surface of the recording conveyor belt 21 and conveyed from the right side to the left side in FIG. 1.

A paper sheet suction portion 25 is provided at a position on the inner side of the recording conveyor belt 21 in the recording conveyor portion 20, which corresponds to the rear side of the upper surface of the recording conveyor belt 21. The paper sheet suction portion 25 is provided on its upper surface with a multitude of air suction holes (not shown). By using the paper sheet suction portion 25, the recording conveyor portion 20 is capable of sucking air downward from an upper surface thereof. Furthermore, the recording conveyor belt 21 is also provided with a multitude of air suction holes (not shown). Thus, by using the recording conveyor belt 21 and the paper sheet suction portion 25, the recording conveyor portion 20 conveys the paper sheet P in a state of being sucked onto the upper surface of the recording conveyor belt 21.

Meanwhile, the printer 1 receives an image data signal representing a character, a graphic, a pattern, or the like from an external computer (not shown). Information on image data thus received is transmitted to the recording portion 30 disposed above and in opposition to the recording conveyor portion 20. The recording portion 30 is disposed such that a minute gap (of, for example, 1 mm) is provided between a bottom surface thereof on which a tip end portion of each ink discharge nozzle (not shown) is disposed and a paper sheet conveying surface that is the upper surface of the recording conveyor belt 21.

The recording portion 30 includes four line type ink jet heads 31 (hereinafter, referred to as line type heads) that are ink heads. Each of the line type heads 31 extends toward a paper sheet width direction perpendicular to the paper sheet conveying direction. The four line type heads 31 are disposed in a row along a rotation direction of the recording conveyor belt 21 from the upstream side toward the downstream side in the rotation direction. The four line type heads 31 are, in order from the upstream side, a line type head 31K for a black ink, a line type head 31C for a cyan ink, a line type head 31M for a magenta ink, and a line type head 31Y for a yellow ink. The line type heads 31 are replenished with inks of the respective colors from unshown ink tanks. In the following description, identification symbols "K", "C", "M", and "Y" are to be omitted unless there is a particular need for discrimination.

In accordance with information on image data received from the external computer, each of the line type heads 31 in the recording portion 30 discharges ink from the ink discharge nozzle toward the paper sheet P placed on the surface of the recording conveyor belt 21. As the recording conveyor belt 21 is rotated, the inks of the respective colors are discharged sequentially from the line type heads 31 at prescribed timing. Thus, on the paper sheet P on the surface of the recording conveyor belt 21, a multiple full-color ink image in which the inks of the four colors of black, cyan, magenta, and yellow are superimposed on one another is formed and recorded. The printer 1 is capable also of recording a monochrome ink image.

A drying device 40 is provided on the left side of the recording conveyor portion 20 and downstream thereof in the paper sheet conveying direction. The paper sheet P on which the ink image has been recorded in the recording portion 30 is sent to the drying device 40, and the inks that have been discharged onto the surface of the paper sheet P are dried by the drying device 40.

A de-curler portion 9 is provided downstream of the drying device 40 in the paper sheet conveying direction and in the vicinity of a left side surface of the main body 2. The paper sheet P on which the inks have been dried in the drying device 40 is sent to the de-curler portion 9, where curl of the paper sheet P is corrected by use of a plurality of rollers arranged in the paper sheet width direction.

A paper sheet guiding portion 10 is provided above the de-curler portion 9 and downstream thereof in the paper sheet conveying direction. In a case where two-sided recording is not performed, the paper sheet P that has passed through the de-curler portion 9 is ejected from the paper sheet guiding portion 10 onto a paper sheet ejection tray 11 provided at a position outside the left side surface of the printer 1.

A paper sheet reversing portion 12 for performing two-sided recording is provided in an upper portion of the main body 2 and above the recording portion 30 and the drying device 40. In a case where two-sided recording is performed, the paper sheet P that has passed through the drying device 40 and the de-curler portion 9 after completion of recording on a first surface thereof is sent to the paper sheet reversing portion 12 via the paper sheet guiding portion 10. The paper sheet P that has been sent to the paper sheet reversing portion 12 subsequently has its conveying direction reversed for recording of a second surface thereof. The paper sheet P is then sent through an upper end portion of the main body 2 toward the right side, after which it again passes through the paper sheet conveying portion 7 to be sent to the recording conveyor portion 20.

Figure 2:
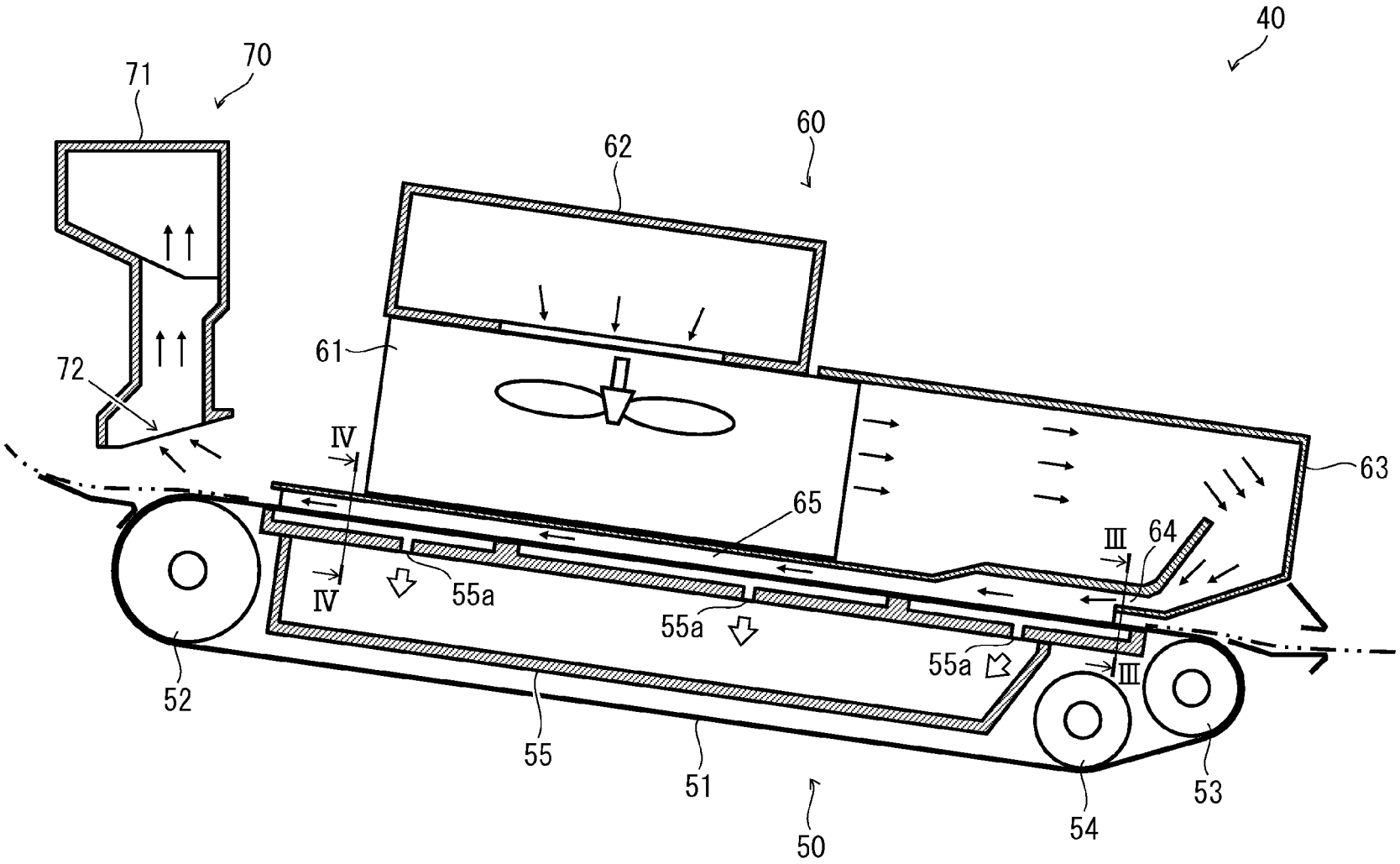
FIG. 2 is a vertical sectional front view of the drying device shown in FIG. 1.
Figure 3:
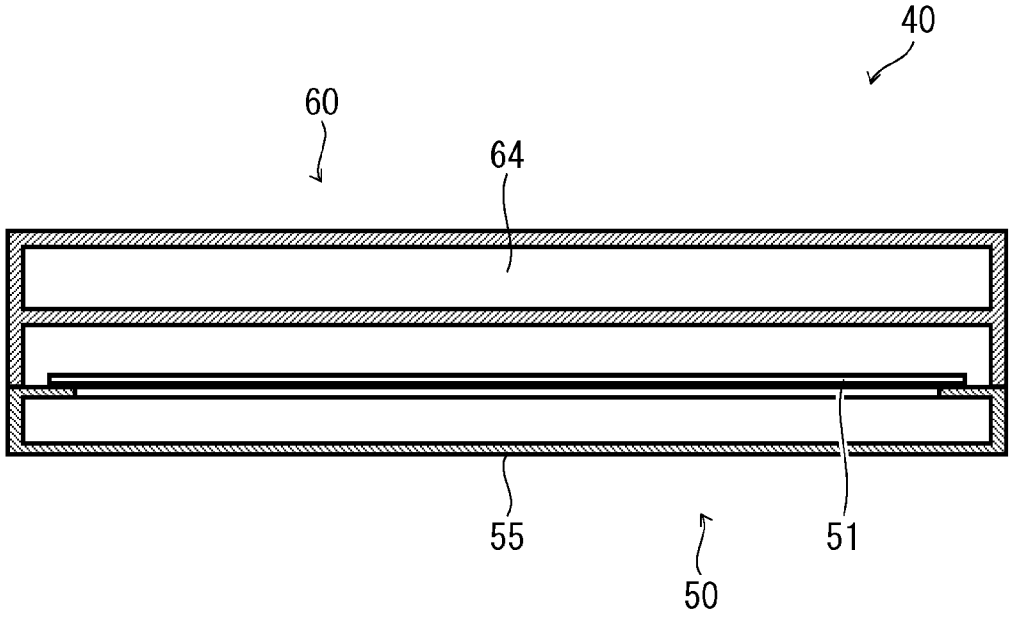
FIG. 3 is a vertical sectional view of the drying device shown in FIG. 2 taken on line III-III as seen from a paper sheet conveying direction.
Figure 4:
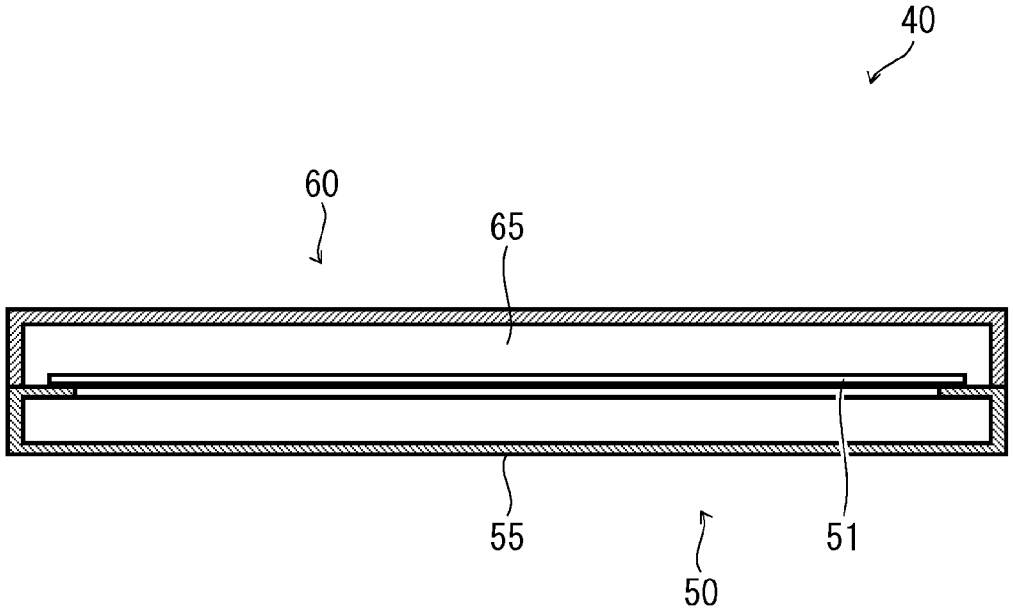
FIG. 4 is a vertical sectional view of the drying device shown in FIG. 2 taken on line IV-IV as seen from the paper sheet conveying direction.

Next, the following describes a detailed configuration of the drying device 40 with reference to FIGS. 2 to 4 as well as FIG. 1. FIG. 2 is a vertical sectional front view of the drying device 40, FIG. 3 is a vertical sectional view of the drying device 40 shown in FIG. 2 taken on line III-III as seen from the paper sheet conveying direction, and FIG. 4 is a vertical sectional view of the drying device 40 shown in FIG. 2 taken on line IV-IV as seen from the paper sheet conveying direction. In FIG. 2, a flow of air generated by a paper sheet suction portion is indicated by a hollow arrow, a flow of air generated by a blower fan is indicated by a solid line arrow, and a paper sheet conveying path (a portion thereof included in an air blowing passage is omitted) is indicated by a chain double-dashed line.

As shown in FIG. 2, the drying device 40 includes a drying conveyor portion 50, a blower portion 60, and an air exhaust portion 70.

The drying conveyor portion 50 includes an endless drying conveyor belt 51 wound around a drive roller 52, a driven roller 53, and a tension roller 54. The drying conveyor belt 51 is rotated by the drive roller 52 in a counterclockwise direction in FIG. 2. The paper sheet P fed out by the recording conveyor portion 20 is placed on an upper surface of the drying conveyor belt 51 and conveyed from the right side to the left side in FIG. 2.

A paper sheet suction portion 55 is provided at a position on the inner side of the drying conveyor belt 51 in the drying conveyor portion 50, which corresponds to the rear side of the upper surface of the drying conveyor belt 51. The paper sheet suction portion 55 is provided on its upper surface with a multitude of air suction holes 55*a*. By using the paper sheet suction portion 55, the drying conveyor portion 50 is capable of sucking air downward from an upper surface thereof. Furthermore, the drying conveyor belt 51 is also provided with a multitude of air suction holes (not shown). Thus, by using the drying conveyor belt 51 and the paper sheet suction portion 55, the drying conveyor portion 50 conveys the paper sheet P in a state of being sucked onto the upper surface of the drying conveyor belt 51.

The blower portion 60 is disposed above the drying conveyor portion 50 across the paper sheet conveying path. The blower portion 60 includes a blower fan 61, an air intake duct 62, a blower duct 63, a blower nozzle 64, and an air blowing passage 65.

The blower fan 61 is, for example, a centrifugal fan and is provided immediately above the paper sheet conveying path. The blower fan 61 is disposed such that a rotary shaft line thereof is vertical to a paper sheet conveying surface. An air intake side of the blower fan 61 is oriented upward in a shaft line direction, while an air exhaust side thereof is oriented outward in a radial direction and toward the upstream side in the paper sheet conveying direction.

The air intake duct 62 is provided above the blower fan 61 and joined to the air intake side of the blower fan 61. The air intake duct 62 extends in the front-back direction of the main body 2, namely, a direction vertical to the plane of FIG. 2 and has an air intake port (not shown) at an end portion thereof on the front side of the main body 2. When the blower fan 61 is driven, air outside the printer 1 is sucked in from the air intake port provided at the front of the main body 2 and passes through the air intake duct 62 to reach the air intake side of the blower fan 61.

The blower duct 63 is provided on the upstream side of the blower fan 61 in the paper sheet conveying direction and joined to the air exhaust side of the blower fan 61. The blower duct 63 extends from a position on the air exhaust side of the blower fan 61 toward the upstream side in the paper sheet conveying direction. At a position at a substantially upstream end of the drying conveyor portion 50, the blower duct 63 is oriented downward and extends further toward the downstream side in the paper sheet conveying direction. That is, when seen from the front, the blower duct 63 extends so as to be curved in substantially a U-shape having a bent portion on the upstream side in the blower duct 63 in the paper sheet conveying direction.

The blower nozzle 64 is provided at a downstream end of the blower duct 63 in an air blowing direction. As shown in FIGS. 2 and 3, the blower nozzle 64 is disposed immediately above the paper sheet conveying surface of the drying conveyor belt 51 across the paper sheet conveying path. Driving the blower fan 61 causes air flowing through the blower duct 63 to be blown off from the blower nozzle 64. The blower nozzle 64 is provided in such an orientation as to blow air toward the paper sheet P forward in a paper sheet conveying direction so that the air is blown substantially parallel to an ink recording surface of the paper sheet P being conveyed by the drying conveyor belt 51 and substantially parallel to the paper sheet conveying direction.

The blower nozzle 64 is disposed on the downstream side relative to an upstream end of the paper sheet suction portion 55 in the drying conveyor portion 50 in the paper sheet conveying direction. Thus, the paper sheet P being conveyed on the drying conveyor belt 51 is sucked by the paper sheet suction portion 55 onto the drying conveyor belt 51 before air is blown thereto from the blower nozzle 64. This can prevent the paper sheet P from flapping, being bent, or being conveyed improperly due to air blown from the blower nozzle 64.

The air blowing passage 65 is provided along the conveying path of the paper sheet P that is conveyed on the drying conveyor belt 51. The air blowing passage 65 encloses the paper sheet conveying path in a continuous area extending on the drying conveyor belt 51 from upstream to downstream in the conveying direction (see FIG. 4) and has its upstream and downstream ends open so that the paper sheet P can pass therethrough. The blower nozzle 64 is joined to an upstream portion of the air blowing passage 65, and air blown from the blower nozzle 64 toward the paper sheet P flows through the air blowing passage 65 from upstream toward downstream in the paper sheet conveying direction.

Furthermore, the blower nozzle 64 and the air blowing passage 65 are configured such that a cross-sectional area of the blower nozzle 64 with respect to an air blowing direction (paper sheet conveying direction), which is shown in FIG. 3, is substantially equal to a cross-sectional area of the air blowing passage 65 with respect to an air blowing direction (paper sheet conveying direction), which is shown in FIG. 4.

The air exhaust portion 70 is disposed on the downstream side of the blower portion 60 in the paper sheet conveying direction and above an downstream end of the drying conveyor portion 50. The air exhaust portion 70 includes an air exhaust duct 71.

The air exhaust duct 71 has a suction port 72 disposed downstream of an exit of the air blowing passage 65 in the air blowing direction and is provided so as to be oriented downward. The air exhaust duct 71 extends upward from the suction port 72 and extends also in the front-back direction of the main body 2, namely, the direction vertical to the plane of FIG. 2, with an air exhaust port (not shown) provided at an end portion thereof on the back side of the main body 2. An unshown air exhaust fan is provided at a position where the air exhaust port of the air exhaust duct 71 is provided. When the air exhaust fan is driven, air blown by the blower portion 60 toward the paper sheet P, after having passed through the air blowing passage 65, is sucked in from the suction port 72 and passes through the air exhaust duct 71 to be exhausted from the air exhaust port provided at the back of the main body 2 to the outside behind the main body 2.

As described above, the drying device 40 of the printer 1 includes the blower portion 60 for blowing air toward the paper sheet P substantially parallel to the ink recording surface of the paper sheet P. With this configuration, an airflow is generated that flows along the ink recording surface of the paper sheet P. This prevents air from directly striking the ink recording surface of the paper sheet P, and thus the drying device 40 is capable of causing air to flow smoothly without being decelerated. Thus, ink discharged onto the surface of the paper sheet P can be dried as quickly as possible.

Furthermore, the blower portion 60 blows air toward the paper sheet P forward in the paper sheet conveying direction and substantially parallel to the paper sheet conveying direction in such a manner that the air is blown over a length equal to the width of the paper sheet P. Thus, using a compact configuration, the drying device 40 is capable of blowing air toward the paper sheet P for a long period of time and causing air to flow smoothly as the paper sheet P is conveyed.

Furthermore, the blower portion 60 includes the air blowing passage 65 that encloses the conveying path of the paper sheet P that is conveyed by the drying conveyor portion 50 in a continuous area extending from upstream to downstream in the conveying direction and has its upstream and downstream ends open, through which the paper sheet P passes, so that air blown toward the paper sheet P flows through the air blowing passage 65. With this configuration, air flowing through the air blowing passage 65 travels toward one direction without being diffused or becoming unsteady and without being affected by another flow of air. Thus, the drying device 40 is capable of preventing the paper sheet P from flapping and dust in a surrounding environment from being scattered by blown air.

Furthermore, in the blower portion 60, the blower nozzle 64 and the air blowing passage 65 are configured such that a cross-sectional area of the blower nozzle 64 with respect to the air blowing direction is substantially equal to a cross-sectional area of the air blowing passage 65 with respect to the air blowing direction. With this configuration, the drying device 40 is capable of preventing an airflow from being decelerated when flowing between the blower nozzle 64 and the air blowing passage 65. Furthermore, the air exhaust portion 70 for exhausting air blown by the blower portion 60 toward the paper sheet P is disposed downstream of the air blowing passage 65. This prevents air from being accumulated in the air blowing passage 65, and thus the drying device 40 is capable of further preventing an airflow from being decelerated.

According to the configuration of the above-described embodiment, the drying device 40 that is capable of drying ink discharged onto the surface of the paper sheet P as quickly as possible can be provided. Furthermore, the printer 1 equipped with the drying device 40 configured as above, which is an ink jet recording apparatus that provides increased reliability and is capable of high-speed recording, can be provided.

Figure 5:
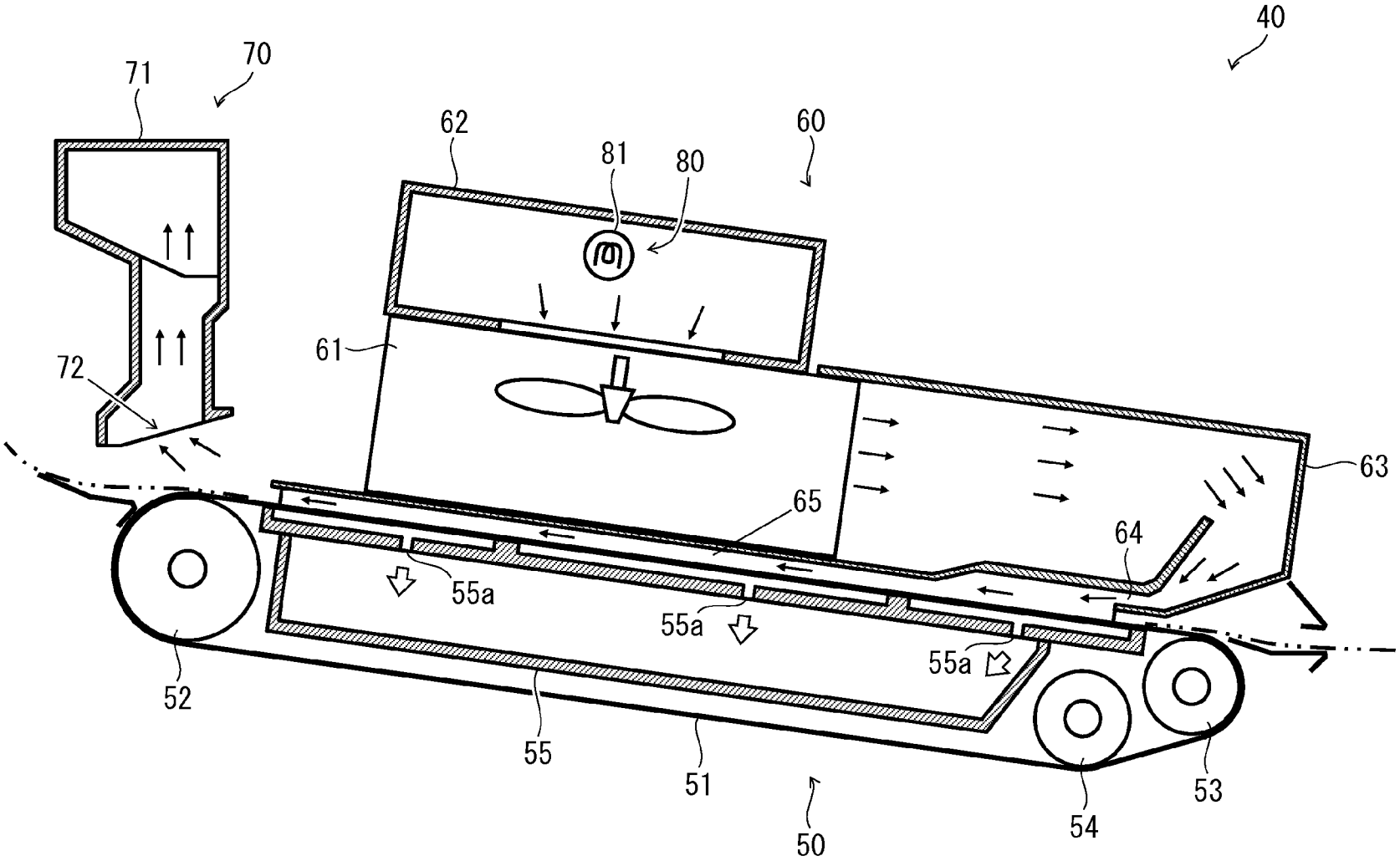
FIG. 5 is a vertical sectional front view of a drying device according to a second embodiment of the present disclosure.

Next, the following describes a drying device according to a second embodiment of the present disclosure with reference to FIG. 5. FIG. 5 is a vertical sectional front view of the drying device. Since this embodiment has essentially the same configuration as that of the first embodiment described earlier with reference to FIGS. 1 to 4, constituent components common to the first embodiment are identified by the same reference characters as in the first embodiment, for which duplicate descriptions are to be omitted.

As shown in FIG. 5, a drying device 40 according to the second embodiment includes, in a blower portion 60, a heating portion 80. The heating portion 80 is disposed in an air intake duct 62 and includes a heater 81. By using the heater 81, the heating portion 80 raises the temperature of air passing through the air intake duct 62. That is, the heating portion 80 raises the temperature of air to be blown toward a paper sheet P.

As another method for causing moisture in ink to evaporate, in addition to the method in which air is blown toward ink discharged onto the paper sheet P, a method is also applicable in which the temperature of air is raised so that water vapor with an increased diffusion coefficient is obtained. According to the configuration of the second embodiment, the heater 81 in the heating portion 80 raises the temperature of air to be blown toward the paper sheet P, and thus, by using the above two methods in combination, the drying device 40 is capable of providing an improved ink drying effect.

Figure 6:
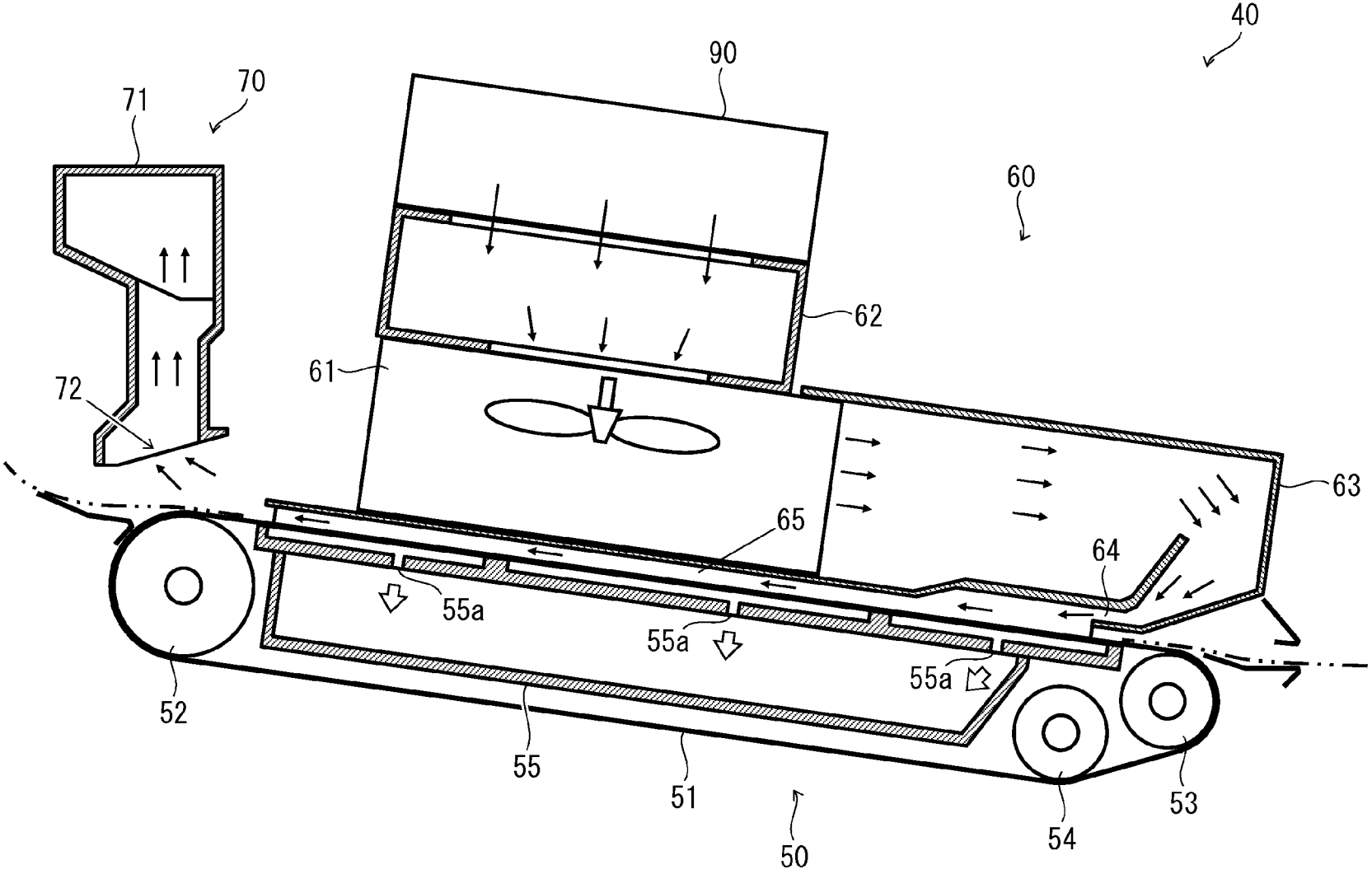
FIG. 6 is a vertical sectional front view of a drying device according to a third embodiment of the present disclosure.

Next, the following describes a drying device according to a third embodiment of the present disclosure with reference to FIG. 6. FIG. 6 is a vertical sectional front view of the drying device. Since this embodiment has essentially the same configuration as that of the first embodiment described earlier with reference to FIGS. 1 to 4, constituent components common to the first embodiment are identified by the same reference characters as in the first embodiment, for which duplicate descriptions are to be omitted.

As shown in FIG. 6, a drying device 40 according to the third embodiment includes, in a blower portion 60, a dehumidification portion 90. The dehumidification portion 90 is disposed at an upstream portion relative to an air intake duct 62 in an air flowing direction. The dehumidification portion 90 includes a dehumidification mechanism such as of a compressor type in which, by use of, for example, a compressor, air is cooled to form condensation in order that water vapor contained in the air can be removed or of a zeolite type (desiccant type) in which, by use of a dehumidifying material such as, for example, zeolite, silica gel, or the like, water vapor contained in air is removed. By using either of these dehumidification mechanisms, the dehumidification portion 90 removes water vapor contained in air that is to pass through the air intake duct 62. That is, the dehumidification portion 90 removes water vapor contained in air to be blown toward a paper sheet P so that the relative humidity of the air is lowered.

As another method for causing moisture in ink to evaporate, in addition to the method in which air is blown toward ink discharged onto the paper sheet P, a method is also applicable in which the relative humidity of air is lowered so that the water vapor pressure of the air is decreased. According to the configuration of the third embodiment, the dehumidification portion 90 removes water vapor contained in air to be blown toward the paper sheet P so that the relative humidity of the air is lowered, and thus, by using the above two methods in combination, the drying device 40 is capable of providing an improved ink drying effect.

Figure 7:
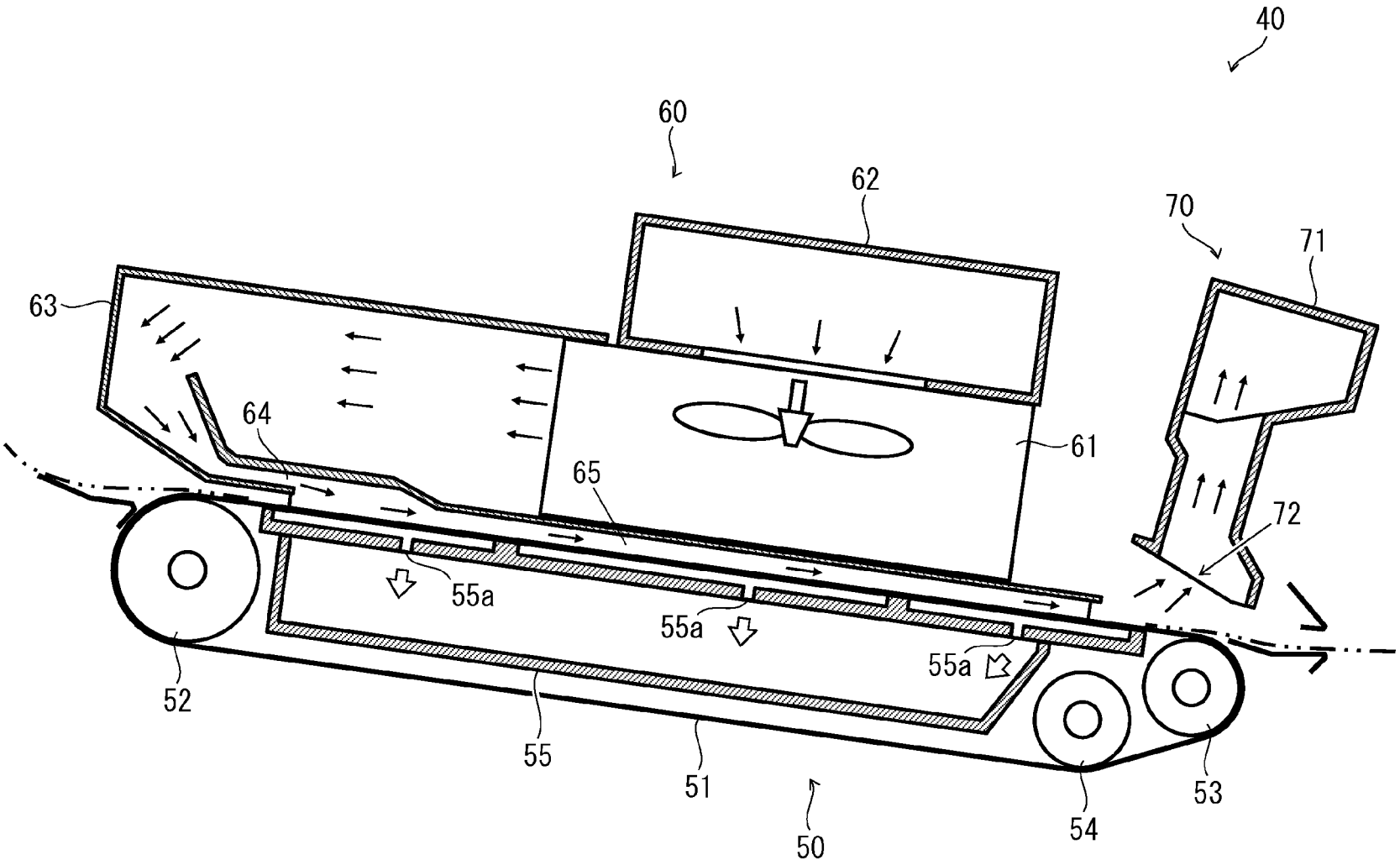
FIG. 7 is a vertical sectional front view of a drying device according to a fourth embodiment of the present disclosure.

Next, the following describes a drying device according to a fourth embodiment of the present disclosure with reference to FIG. 7. FIG. 7 is a vertical sectional front view of the drying device. Since this embodiment has essentially the same configuration as that of the first embodiment described earlier with reference to FIGS. 1 to 4, constituent components common to the first embodiment are identified by the same reference characters as in the first embodiment, for which duplicate descriptions are to be omitted.

In a drying device 40 according to the fourth embodiment, a blower portion 60 shown in FIG. 7 is disposed such that, compared with the first embodiment described with reference to FIG. 2, its orientation with respect to a paper sheet conveying direction is reversed. That is, a blower nozzle 64 is disposed above a downstream portion of a drying conveyor portion 50 in the paper sheet conveying direction in such an orientation as to blow air toward a paper sheet P backward in the paper sheet conveying direction. An air blowing passage 65 encloses a paper sheet conveying path in a continuous area extending on a drying conveyor belt 51 from downstream to upstream. Air blown from the blower nozzle 64 toward the paper sheet P flows through the air blowing passage 65 from downstream toward upstream in the paper sheet conveying direction.

According to this configuration, the drying device 40 is capable of increasing the relative velocity of an airflow with respect to the paper sheet P and thus is capable of providing a further improved effect of drying ink discharged onto the paper sheet P.

The blower nozzle 64 is disposed on the upstream side relative to a downstream end of a paper sheet suction portion 55 in the drying conveyor portion 50 in the paper sheet conveying direction. Thus, the paper sheet P being conveyed on the drying conveyor belt 51 is released from a state of being sucked onto the drying conveyor belt 51 by the paper sheet suction portion 55 after the blower nozzle 64 has completed air blowing thereto. This can prevent the paper sheet P from flapping, being bent, or being conveyed improperly due to air blown from the blower nozzle 64.

Figure 8:
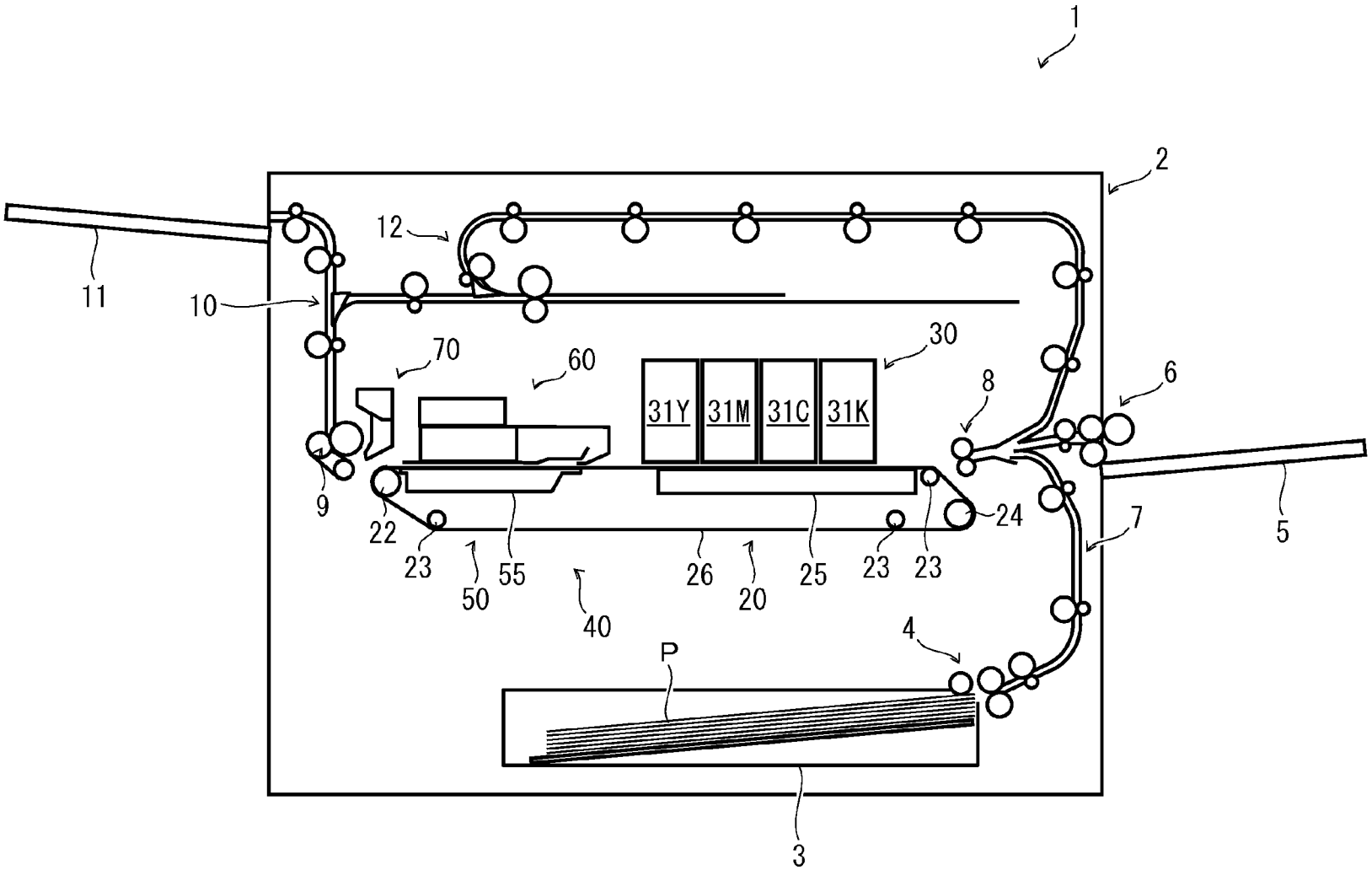
FIG. 8 is a schematic vertical sectional front view of an ink jet recording apparatus equipped with a drying device according to a fifth embodiment of the present disclosure.

Next, the following describes an ink jet recording apparatus equipped with a drying device according to a fifth embodiment of the present disclosure with reference to FIG. 8. FIG. 8 is a schematic vertical sectional front view of an ink jet type printer as one example of the ink jet recording apparatus. Since this embodiment has essentially the same configuration as that of the first embodiment described earlier with reference to FIGS. 1 to 4, constituent components common to the first embodiment are identified by the same reference characters as in the first embodiment, for which duplicate descriptions are to be omitted.

In a printer 1 according to the fifth embodiment, as shown in FIG. 8, a drying conveyor portion 50 that conveys a paper sheet P in order to dry ink discharged onto the paper sheet P is formed integrally with a recording conveyor portion 20 that conveys the paper sheet P in order to discharge ink onto the paper sheet P. That is, a paper sheet conveyor belt 26 is wound around a drive roller 22, a driven roller 23, and a tension roller 24 and extends from downstream of a registration roller pair 8 to upstream of a de-curler portion 9 in a paper sheet conveying direction.

A recording portion 30 and a blower portion 60 are disposed above and in opposition to an upper surface of the paper sheet conveyor belt 26. A paper sheet suction portion 25 in the recording conveyor portion 20 and a paper sheet suction portion 55 in the drying conveyor portion 50 are both disposed at positions on the inner side of the paper sheet conveyor belt 26, respectively, which correspond to the rear side of the upper surface of the paper sheet conveyor belt 26. The paper sheet P fed out by the registration roller pair 8 is placed on the upper surface of the paper sheet conveyor belt 26. The paper sheet P placed on the upper surface of the paper sheet conveyor belt 26 undergoes a sequence of processing in which an image is recorded by discharging ink onto the paper sheet P by the recording portion 30 and, without intermission, the ink is dried by a drying device 40.

According to this configuration, an airflow having a highest possible velocity can be obtained to be used for causing moisture in ink discharged onto a surface of the paper sheet P to evaporate, and moreover, the printer 1 can be structurally simplified.

The embodiments of the present disclosure having been discussed thus far are not intended to limit the scope of the present disclosure thereto and may be variously modified without departing from the spirit of the invention.

For example, although each of the foregoing embodiments of the present disclosure describes, as an example, the drying device 40 included in the printer 1 that is an ink jet recording apparatus, an apparatus to which the present invention is applicable is not limited to an ink jet recording apparatus. The drying device of the present disclosure may be included in an apparatus of any other type than an ink jet recording apparatus.

Furthermore, although the ink jet type printer 1 equipped with the drying device 40 is an ink jet recording apparatus including the line type heads 31 corresponding to four colors, an ink jet recording apparatus to which the present invention is applicable is not limited to this type. As an ink jet recording apparatus to which the present invention is applicable, an ink jet recording apparatus of a type adapted to printing in a higher number of colors or an ink jet recording apparatus of a monochrome type may be used.

Furthermore, although, in each of the foregoing embodiments, the blower portion 60 in the drying device 40 is configured to blow air toward the paper sheet P substantially parallel to the paper sheet conveying direction, the blower portion 60 may be configured to blow air toward the paper sheet P from the paper sheet width direction. In such a case, it is desirable that the blower nozzle 64 be provided so as to be able to blow air across substantially an entire region on the drying conveyor belt 51 from its upstream portion to its downstream portion in the paper sheet conveying direction. By this configuration, ink discharged onto a surface of the paper sheet P can be dried as quickly as possible.

Furthermore, the heating portion 80 described in the second embodiment and the dehumidification portion 90 described in the third embodiment may be applied in combination with each other. Moreover, the heating portion 80 and the dehumidification portion 90 may be applied also to the fourth embodiment or the fifth embodiment.

What is claimed is:

1. A drying device that dries ink discharged onto a surface of a recording medium, comprising:

a drying conveyor portion that conveys the recording medium; and a blower portion that blows air toward the recording medium substantially parallel to an ink recording surface of the recording medium being conveyed by the drying conveyor portion and substantially parallel along a direction in which conveyance of the recording medium proceeds, wherein the drying conveyor portion includes a drying conveyor belt which conveys the recording medium placed on an upper surface thereof, a suction portion which is provided at a position corresponding to a reverse side of the upper surface of the drying conveyor belt and which sucks air downward of the drying conveyor belt, and an air suction hole which is provided in the drying conveyer belt, the drying conveyor portion conveying the recording medium while sucking the recording medium onto the upper surface of the drying conveyor belt by using the drying conveyor belt and the suction portion, and the blower portion includes a blower fan which is arranged over a downstream-side portion of the drying conveyor portion with respect to a recording medium conveying direction, across a recording medium conveying path, and of which an exhaust side points upstream with respect to the recording medium conveying direction, a blower duct which is arranged on an upstream side of the blower fan with respect to the recording medium conveying direction, which is coupled to the exhaust side of the blower fan, and which extends first upstream with respect to the recording medium conveying direction, then bends downward over an upstream-side end of the drying conveyor portion with respect to the recording medium conveying direction, and then further extends downstream with respect to the recording medium conveying direction, and a blower nozzle which is provided at a downstream-side end of the blower duct with respect to an air blowing direction, which is arranged over a recording medium conveying surface of the drying conveyor belt, across the recording medium conveying path, and which is arranged downstream of an upstream-side end of the suction portion with respect to the recording medium conveying direction.

2. The drying device according to claim 1, wherein the blower portion comprises an air blowing passage that encloses a conveying path along which a recording medium is conveyed by the drying conveyor portion in a continuous area extending from upstream to downstream in the conveying direction and has upstream and downstream ends thereof open, through which the recording medium passes, so that air blown toward the recording medium flows through the air blowing passage.

3. The drying device according to claim 2, wherein in the blower portion, a blower nozzle that blows air toward a recording medium and the air blowing passage are configured such that a cross-sectional area of the blower nozzle with respect to an air blowing direction is substantially equal to a cross-sectional area of the air blowing passage with respect to the air blowing direction.

4. The drying device according to claim 2, further comprising:

an air exhaust portion that is disposed downstream of the air blowing passage and exhausts air blown by the blower portion toward a recording medium.

5. The drying device according to claim 1, wherein the blower portion comprises a heating portion that raises a temperature of air to be blown toward a recording medium.

6. The drying device according to claim 1, wherein the blower portion comprises a dehumidification portion that removes water vapor contained in air to be blown toward a recording medium.

7. An ink jet recording apparatus comprising the drying device according to claim 1.

8. The ink jet recording apparatus according to claim 7, further comprising:

a recording conveyor portion that conveys a recording medium in order to discharge ink onto a surface of the recording medium, wherein the drying conveyor portion is formed integrally with the recording conveyor portion.

* * * * *